US007658362B2

(12) United States Patent
El Haje

(10) Patent No.: US 7,658,362 B2
(45) Date of Patent: Feb. 9, 2010

(54) TWO PIECE WALL HANGER

(76) Inventor: Emad El Haje, 1800 Eye St., NW., Suite 801, Washington, DC (US) 20006

( * ) Notice: Subject to any disclaimer, the term of this patent is extended or adjusted under 35 U.S.C. 154(b) by 218 days.

(21) Appl. No.: 11/528,245

(22) Filed: Sep. 28, 2006

(65) Prior Publication Data

US 2008/0078915 A1 Apr. 3, 2008

(51) Int. Cl.
*A47G 1/24* (2006.01)

(52) U.S. Cl. ..... 248/475.1; 248/216.1; 248/220.31; 248/468

(58) Field of Classification Search ..... 248/220.31, 248/206.5, 475.1, 476, 479, 472, 474, 466–468, 248/216.1, 216.4, 217.2
See application file for complete search history.

(56) References Cited

U.S. PATENT DOCUMENTS

| | | | | |
|---|---|---|---|---|
| 4,066,342 | A * | 1/1978 | Arends et al. | 359/873 |
| 4,522,365 | A * | 6/1985 | Tabares | 248/466 |
| 4,687,165 | A * | 8/1987 | Blackburn | 248/274.1 |
| 4,976,055 | A * | 12/1990 | Kane | 40/745 |
| 6,299,123 | B1 * | 10/2001 | Hayde | 248/476 |
| 6,663,075 | B2 * | 12/2003 | Zuller | 248/476 |
| 6,685,067 | B2 * | 2/2004 | French | 224/198 |
| 7,464,908 | B2 * | 12/2008 | Files | 248/229.16 |

* cited by examiner

*Primary Examiner*—J. Allen Shriver, II
*Assistant Examiner*—Steven M Marsh
(74) *Attorney, Agent, or Firm*—Barnes & Thornburg LLP

(57) ABSTRACT

A two piece hanger device for mounting an object on a wall wherein one piece is mounted on the object and one piece is mounted on the wall and wherein one of the two pieces can be angularly adjusted with respect to the other to permit proper horizontal alignment of the object to be hung.

10 Claims, 3 Drawing Sheets

TWO PIECE WALL HANGER

The invention relates to a two piece wall hanger that is used to hang pictures, photographs, medallions, etc. to a wall.

BACKGROUND AND SUMMARY

There are many different types of wall hangers which are used for mounting and hanging art work and related items to room wall surfaces. One problem associated with existing two piece hangers is that exacting orientation of the hangers on the wall and the article to be hung is required so as to avoid leaning of the hung article so that its orientation will be horizontal and parallel to the floor and ceiling of the room.

The current invention provides for correct orientation by allowing some relative movement between the hanger piece on the wall and the hanger piece on the object to be hung on the wall.

Further the attachment of the two hanger pieces to one another should provide for some physical connection between the two hanger pieces to keep the two hanger pieces from separating and to cause the two hanger pieces to resist vertical movement between them so as to be able to support the object to be held against the wall. With light weight objects to be hung, stopping relative movement is easier than when the objects weigh more. For example, a one pound picture frame puts less of a vertical strain on a hanger mounting than does a ten pound picture frame.

Other aspects of the present disclosure will become apparent from the following descriptions when considered in conjunction with the accompanying drawings.

DETAILED DESCRIPTION

Figure 1:
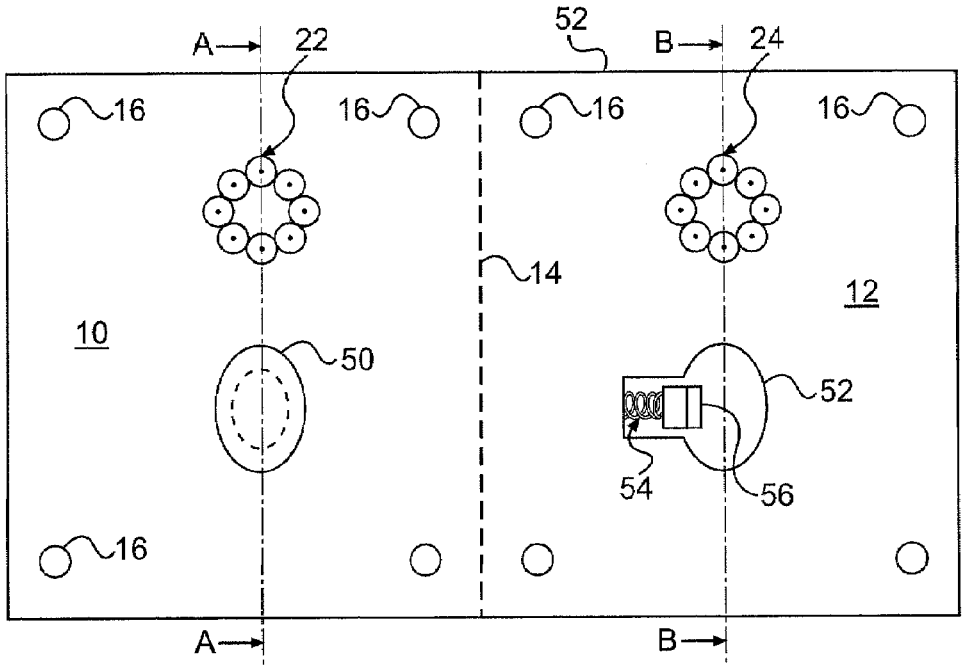
FIG. 1 show a first embodiment of the two piece hanger wherein the two pieces of the hanger are formed unitary with a perforated tear line between them.
Figure 2:
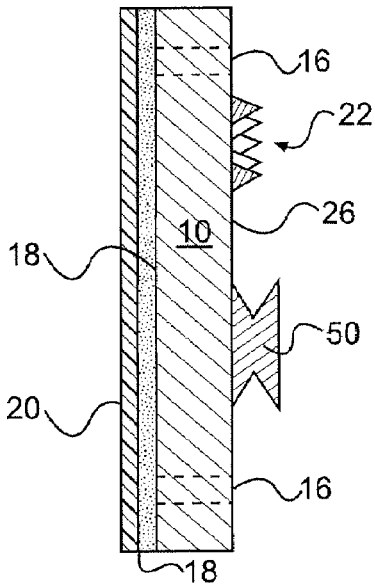
FIG. 2 shows a cross-section of the hanger of FIG. 1 taken along the line A-A.
Figure 3:
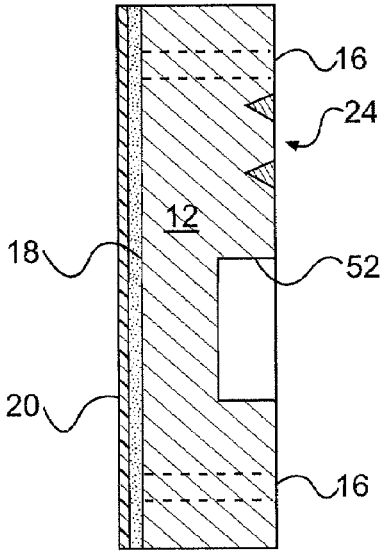
FIG. 3 shows a cross-section of the hanger of FIG. 1 taken along the line B-B.
Figure 4:
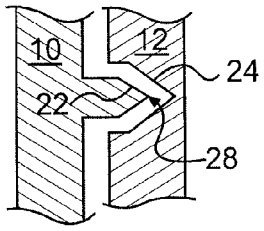
FIG. 4 shows a partial cross-section of one of the finger portions of the hanger of FIG. 1, when the two hanger pieces are connected.

FIG. 1 show a unitary article hanger having an article piece 10 and a wall piece 12 separated by a perforation line 14. One can separate the two pieces by tearing along the perforation line by a bending and pulling motion between the two pieces 10 and 12. A plurality of holes 16 are formed in each of the two pieces to provide an entry for either nails or screws (not shown) to secure the piece 10 non-rotatably to the article to be held (not shown) and the piece 12 to the room wall (not shown) on which the article is to hang. An alternative or supplemental securement for the pieces is provided by an adhesive coating 18 on the back-side of the two pieces. A removable covering paper 20 can be provided on top of the adhesive. These covering papers 20 for protecting adhesive surface until time for use are well known.

A plurality of pins 22 are placed in a circle around an upper portion of the piece 10 and extend outwardly from the piece 10 on the piece surface 26 opposite the adhesive surface 18. These pins 22 are round with a conical tip 28. The pins 22 are placed very close to one another for alignment purposes as will be explained latter. The distance between pins should ideally be less than ½ the diameter of the pin. The wall piece 12, is provided with a plurality of pin receptacles 24, which are configured to be identical in shape and in the same circular array as the pins 22, so as to provide a friction fit therewith as each of the pins 22 is inserted into a respective pin hole 24, for supporting and orienting the two pieces 10 and 12 during the hanging operation. The piece 10 is made rectangular or square with a flat straight top edge 30, which is made straight so as to be more easily aligned parallel with a top edge of the article to be hung.

Once the piece 10 is attached to the article to be hung and the piece 12 to the wall on which the article is to be hung, the pins 22, on piece 10 are inserted into holes 24 on piece 12. Because of the number of pins 22 and holes 24 and their closeness to one another, slight vertical misalignment between the pieces 10 and 12 with the floor and ceiling and floor of the room can be accommodated due to a small relative rotation of piece 10. This is occasioned, by the fact, that the top most pin 22 on piece 10 (that is the pin closest to the top edge 30) can be placed in any of the top holes 24 (closest to top edge 33) of piece 12. Thus, even if piece 12 was not mounted accurately, holding the object to be mounted level, will allow an alignment of pins 22 and holes 24 that will provide a proper horizontal orientation of the object to be held.

Since the size of the pins 22 are the same as the holes 24, a friction fit will occur which will allow the person hanging an object to push the object hard against the wall, so the pins 22 enter the holes 24 and are held frictionally therein. The point 28 on the end of the pins 22 assists in aligning a pin 22 with a hole 24, since as the point 28 enters the hole 24, the pin shaft is centered in the hole 24 as the point rides into and along an edge of the hole 24.

Figure 6:
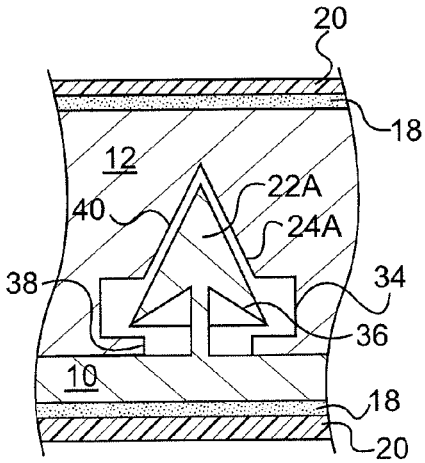
FIG. 6 shows a partial cross-sectional view of a second embodiment of either the finger or latch portions of the invention, when the two hanger pieces are connected.
Figure 7:
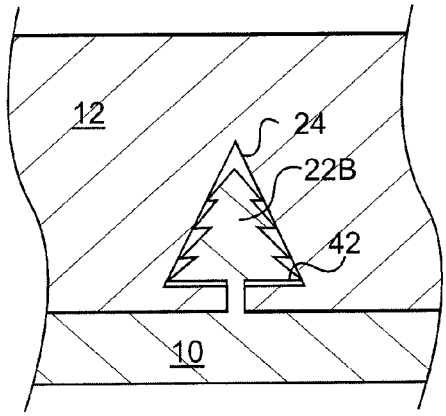
FIG. 7 shows a partial cross-sectional view of a third embodiment of either the finger on latch portions of the invention, when the two hanger pieces are connected.
Figure 8:
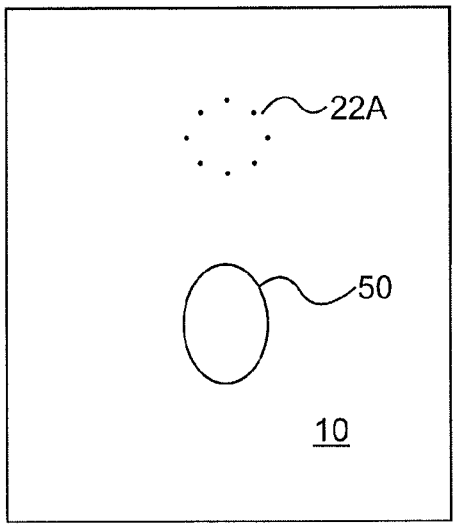
FIGS. 8-11 are another embodiment of the invention similar to FIG. 1, showing the two pieces of the hanger separated and with the modified version of fingers (FIGS. 8 and 9) and their modified finger received area (FIGS. 10 and 11).

While FIGS. 1-4 show the configurations of the pins 22 to be round with a center tip 28, the pins could be configured as an arrow or Christmas tree shape as respectively shown in FIGS. 6 and 7. In FIG. 6 the arrow configuration of pin 22A provides a flexible lower tip 36 which is flexed inwardly to pass through opening 38 and then expand into enlarged portion 34. This expansion will hold the two pieces 10 and 12 together and inhibit vertical movement between them. Since the outer surface of the tip 36 does not extend all the way to the end of enlarged portion 34, and since the tip 36 is thin and flexible, the pieces 10 and 12 can be separated by pulling the piece 10 on the article to be hung away from the piece 12, mounted on the wall. This pulling will cause the tips to flip over, as shown by the arrow 40 (FIG. 6) so the pin 22A can pass through opening 38 as the piece 10 is pulled away from piece 12.

The Christmas tree configuration of FIG. 7 has a pin 22B and fingers 42. As the pin 22B is inserted into the hole 24, the fingers 42 will be compressed downwardly closer to the center of the pin 22B, thus, increasing the frictional forces on the holes 24 to increase the holding power over the smooth sides, shown in FIG. 4. A Christmas tree configuration means a stem with multiple angled fingers extended from the stem.

Figure 5:
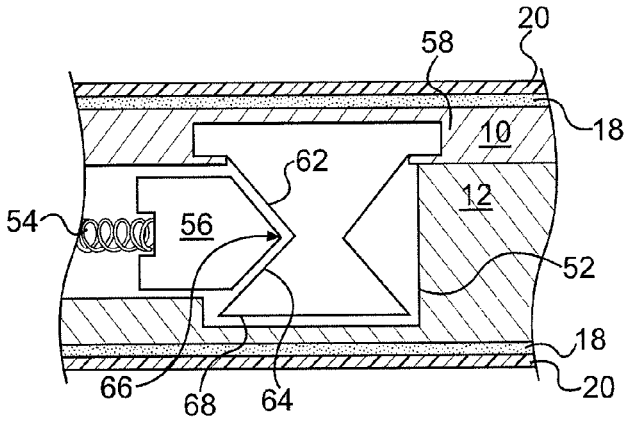
FIG. 5 shows a partial cross-sectional view of the spring latch of the hanger of FIG. 1, when the two hanger pieces are connected.

While it is believed that the previously described pins 22 and holes 24 would provide sufficient support for most objects to be hung, an additional or supplemental latch mechanism between the pieces 10 and 12 can be provided to support heavy objects. As shown in FIGS. 1 and 5 a latch plug 50 is attached into slot 58 in piece 10. The top 60 of plug 50 is flexed to be inserted into slot 58 and has a lesser size than the slot to allow some relative movement between the plug 50 and the piece 10. The plug 50 has an hour glass external shape with slopping sides 62 and 64. Internally of the piece 12 is an opening 52, sized to receive the plug 50. A spring 54 loaded plunger 56 with slanting end edge 66 is also located in piece 12. When the two pieces 10 and 12 are first pressed together, an outer edge of the bottom 68 of plug 50 would contact top surface 62 of the plunger and because of the slope 66 of the plunger 56, the plunger 56 will be cammed to the left (FIG. 5) against the bias of spring 54 to allow for insertion of the plug 50. As the plug 50 moves downwardly (FIG. 5) of the opening 52, the plunger 56 can move to the right, because of the hour glass internal surface of plug 50. When returned to the position shown in FIG. 5 the plunger 56 will hold the pieces 10 and 12 together. The pieces 10 and 12 can be released from one another by pulling them apart where upon surface 64, of plug 50, will contact the lower (FIG. 5) surface 66, of plunger 56, and cause it to be cammed against spring 54 (to the left) to allow plug bottom surface 68 to pass by the tip of plunger 56 to separate pieces 10 and 12. The camming action of plunger 56 is the same as found in most door knobs. The top 60, of plug 50 is smaller than slot 58 into which it is inserted to allow the plug 50 to move relative to piece 10, to accommodate the fact that top pin 22 will not always be in top holes 24 due to alignment purposes as previously explained. The arrow configuration of FIG. 6 could replace the FIG. 5 locking device and as the stem of the arrow can bend, the arrow can act to accommodate misalignment between the two pieces 10 and 12.

Figure 9:
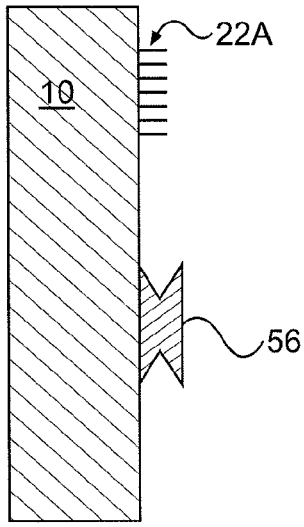
Figure 10:
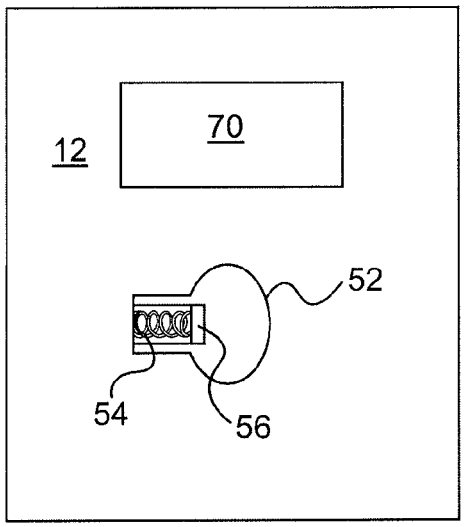
Figure 11:
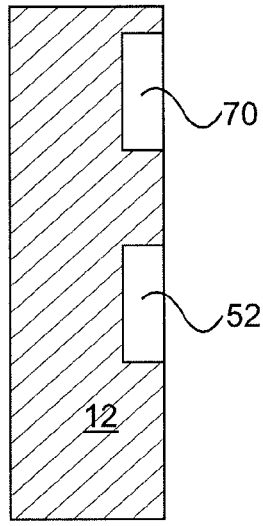

FIGS. 9-11 show an alternative pin 22 and hole 24 attachment from that of FIGS. 1-4. Here the pins 22A are thin nails. The holes 24 are replaced with a sticky pad 70. Once the object to be hung is properly aligned, the nails are pressed into the pad 70 after its piece 12 was mounted on the wall and is held by friction between the nails 22A and the sticky pad 70. The sides of the nail can be roughed so as to increase the frictional force with the sticky pad 70. Alternatively, the nails could be configured as the arrow or christmas tree of FIGS. 6 and 7. The sticky pad 70 needs to stay sticky throughout its life, to allow for removal of piece 10 from piece 12.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

I claim:

1. A hanger means for securing an object to be hung to a room wall comprising:

a first piece with means to secure the first piece to the object to be hung;

a second piece with means to secure the second piece to a wall of a room to which the item to be hung is to be placed;

a plurality of pins projecting from the first piece or securing the first piece to the second piece, the plurality of pins placed in a circle very close to one another and with the pins having points at least at an outer edge of the pin which extends from and projects from the first piece; and a pin receiving area on the second piece, which pin receiving area surrounds each of the plurality of pins when the first piece is pressed against the second piece to secure the two pieces together by frictional force of the pin receiving area on the second piece against a surface of the pins projecting from the first piece;

wherein the first and second pieces have cooperating means to latch the first and second means together;

wherein the cooperating means include a spring loaded plunger on one of the first and second pieces and a cooperating plug on the other of the first and second pieces; and wherein said cooperating means is located in an area below and remote from the pin receiving area.

2. A hanger means for securing an object to be hung to a room wall comprising:

a first piece with means to secure the first piece to the object to be hung;

a second piece with means to secure the second piece to a wall of a room to which the item to be hung is to be placed;

a plurality of pins projecting from the first piece for securing the first piece to the second piece, the plurality of pins placed in a circle very close to one another and with the pins having points at least at an outer edge of the pin which extends from and projects from the first piece;

a pin receiving area on the second piece, which pin receiving area surrounds each of the plurality of pins when the first piece is pressed against the second piece to secure the two pieces together by frictional force of the pin receiving area on the second piece against a surface of the pins projecting from the first piece;

wherein the pin receiving area contains a plurality of holes equal in number to the plurality of pins;

wherein the holes are placed in a circle of the same size as the circle of pins and are located as close to one another as the pins;

wherein the holes are of a size to frictionally engage the pins when the two pieces are pressed against one another to secure the first piece to the second piece;

wherein the first and second pieces have cooperating means to latch the first and second means together;

wherein the cooperating means include a spring loaded plunger on one of the first and second pieces and a cooperating plug on the other of the first and second pieces; and wherein said cooperating means is located in an area below and remote from the pin receiving area.

3. A hanger means for securing an object to be hung to a room wall comprising:

a first piece with means to secure the first piece to the object to be hung;

a second piece with means to secure the second piece to a wall of a room to which the item to be hung is to be placed;

a plurality of pins projecting from the first piece for securing the first piece to the second piece, the plurality of pins placed in a circle very close to one another and with the pins having points at least at an outer edge of the pin which extends from and projects from the first piece;

a pin receiving area on the second piece, which pin receiving area surrounds each of the plurality of pins when the first piece is pressed against the second piece to secure the two pieces together by frictional force of the pin receiving area on the second piece against a surface of the pins projecting from the first piece;

wherein the pins have the configuration of an arrow at their projecting end;

wherein the first and second pieces have cooperating means to latch the first and second means together;

wherein the cooperating means include a spring loaded plunger on one of the first and second pieces and a cooperating plug on the other of the first and second pieces; and wherein said cooperating means is located in an area below and remote from the pin receiving area.

4. A hanger means for securing an object to be hung to a room wall comprising:

a first piece with means to secure the first piece to the object to be hung;

a second piece with means to secure the second piece to a wall of a room to which the item to be hung is to be placed;

a plurality of pins projecting from the first piece for securing the first piece to the second piece, the plurality of pins placed in a circle very close to one another and with the pins having points at least at an outer edge of the pin which extends from and projects from the first piece;

a pin receiving area on the second piece, which pin receiving area surrounds each of the plurality of pins when the first piece is pressed against the second piece to secure the two pieces together by frictional force of the pin receiving area on the second piece against a surface of the pins projecting from the first piece;

wherein the pin receiving area contains a plurality of holes equal in number to the plurality of pins;

wherein the holes are placed in a circle of the same size as the circle of pins and are located as close to one another as the pins;

wherein the holes are of a size to frictionally engage the pins when the two pieces are pressed against one another to secure the first piece to the second piece;

wherein the pins have the configuration of an arrow at their projecting end;

wherein the first and second pieces have cooperating means to latch the first and second means together;

wherein the cooperating means include a spring loaded plunger on one of the first and second pieces and a cooperating plug on the other of the first and second pieces; and wherein said cooperating means is located in an area below and remote from the pin receiving area.

5. The hanger means of claim 1, wherein the pin receiving area contains a plurality of holes equal in number to the plurality of pins;

wherein the holes are placed in a circle of the same size as the circle of pins and are located as close to one another as the pins; and wherein the holes are of a size to frictionally engage the pins when the two pieces are pressed against one another to secure the first piece to the second piece.

6. The hanger of claim 1, wherein the pins have the configuration of an arrow at their projecting end.

7. The hanger of claim 1, wherein the pins have the configuration of an arrow at their projecting end.

8. The hanger of claim 1, wherein the pins have the configuration of a christmas tree.

9. The hanger of claim 2, wherein the pins have the configuration of a christmas tree.

10. The hanger of claim 1, wherein the pin receiving area of the second piece is a sticky pad into which the pins of the first piece are inserted when the two pieces are pressed together to secure the pieces together.

* * * * *